US008561345B2

(12) United States Patent
Armas

(10) Patent No.: US 8,561,345 B2
(45) Date of Patent: Oct. 22, 2013

(54) APPARATUS FOR DISPLAYING A PLANT

(76) Inventor: James Vincent Armas, Port Jefferson Station, NY (US)

( * ) Notice: Subject to any disclaimer, the term of this patent is extended or adjusted under 35 U.S.C. 154(b) by 0 days.

(21) Appl. No.: 12/861,715

(22) Filed: Aug. 23, 2010

(65) Prior Publication Data

US 2011/0041398 A1 Feb. 24, 2011

Related U.S. Application Data

(60) Provisional application No. 61/236,392, filed on Aug. 24, 2009.

(51) Int. Cl.
*A47G 7/02* (2006.01)

(52) U.S. Cl.
USPC ..... 47/39; 47/67; 47/46

(58) Field of Classification Search
USPC ..... 47/65.5, 66.6, 67, 82, 83, 86, 39, 46, 47
See application file for complete search history.

(56) References Cited

U.S. PATENT DOCUMENTS

| | | | | |
|---|---|---|---|---|
| 554,661 | A | | 2/1896 | Doolittle |
| 1,473,318 | A | | 11/1923 | Ranson |
| 1,566,982 | A | | 12/1925 | Shee |
| 1,628,823 | A | | 5/1927 | Jonnes |
| 1,663,366 | A | | 3/1928 | Berry |
| 1,809,018 | A | | 8/1931 | Bruning |
| 1,913,587 | A | | 6/1933 | Edwards |
| 2,235,966 | A | | 3/1941 | Ellingson |
| 2,544,817 | A | | 3/1951 | White |
| 2,764,384 | A | | 9/1956 | Kirsch |
| 2,770,957 | A | | 11/1956 | Bronson |
| 3,010,256 | A | * | 11/1961 | Ise ..... 47/42 |
| 3,302,328 | A | * | 2/1967 | King ..... 47/47 |
| 3,521,401 | A | * | 7/1970 | Shisler ..... 47/43 |
| 3,559,939 | A | * | 2/1971 | Luna ..... 248/210 |
| D231,296 | S | | 4/1974 | Morris et al. |
| 4,109,415 | A | | 8/1978 | Hall |
| 4,480,403 | A | | 11/1984 | Williams |
| 4,524,542 | A | | 6/1985 | Elliott |
| 4,603,507 | A | | 8/1986 | Nelson |
| 4,666,115 | A | | 5/1987 | Schiro |
| 4,908,982 | A | | 3/1990 | Quatrini |
| 5,220,744 | A | | 6/1993 | Kendall |
| 5,292,014 | A | | 3/1994 | Lelong |
| 5,327,678 | A | | 7/1994 | Schweiker |
| D350,081 | S | | 8/1994 | May |
| 5,395,081 | A | | 3/1995 | Vollink |
| D357,596 | S | | 4/1995 | Kragt et al. |
| 5,457,911 | A | | 10/1995 | Vollink |
| 5,649,386 | A | | 7/1997 | Rynberk |
| 5,966,865 | A | | 10/1999 | Jones |
| 6,299,116 | B1 | | 10/2001 | Levesque |

(Continued)

*Primary Examiner* — Rob Swiatek
*Assistant Examiner* — Lisa Tsang

(57) ABSTRACT

An apparatus for displaying a plant is described. The apparatus includes a first substantially horizontal member that engages a first surface of a structure at a first vertical position. A second substantially horizontal member engages a second surface of the structure at a second vertical position that is lower than the first vertical position. The first surface is opposite to the second surface. A frame is coupled to the second substantially horizontal member and is shaped to support a pot containing the plant. The weight of the supported plant urges the first substantially horizontal member against the first surface of the structure and urges the second substantially horizontal member against the second surface of the structure, thereby securing the apparatus to the structure.

10 Claims, 9 Drawing Sheets

(56) References Cited

U.S. PATENT DOCUMENTS

| | | | | |
|---|---|---|---|---|
| 6,375,141 | B1 * | 4/2002 | Kettlestrings | 248/303 |
| 6,539,665 | B1 | 4/2003 | Liona | |
| 6,672,003 | B2 | 1/2004 | Park | |
| 6,708,832 | B1 | 3/2004 | Hannon | |
| 6,971,204 | B1 * | 12/2005 | Gibney | 47/39 |
| 7,024,816 | B1 | 4/2006 | Marks et al. | |
| 7,263,799 | B2 | 9/2007 | Zanten | |
| 7,275,728 | B1 * | 10/2007 | Branson | 248/302 |
| 7,360,336 | B2 | 4/2008 | Zanten | |
| 7,677,513 | B1 * | 3/2010 | Londo | 248/217.1 |
| 2003/0132355 | A1 | 7/2003 | Denton | |
| 2008/0110087 | A1 | 5/2008 | Serio | |
| 2009/0064573 | A1 | 3/2009 | Braun | |

* cited by examiner

APPARATUS FOR DISPLAYING A PLANT

CROSS REFERENCE TO RELATED APPLICATION

The present application is related to and claims the benefit of priority under 35 U.S.C. §119(e) from U.S. Provisional Application Ser. No. 61/236,392, filed Aug. 24, 2009, the entire contents of which are incorporated herein by reference.

TECHNICAL FIELD

The invention relates generally to displaying plants and other objects on a variety of structures.

BACKGROUND

A typical plant hanger for use on a fence post or a deck railing generally includes an L-shaped bracket having a vertical member that is screwed into the post or railing. The plant may reside in a pot that includes chains or rope connected to a small hook that fits over a horizontal member of the bracket. Another type of bracket includes a large hook that fits over a horizontal structure, such as a deck railing. A hook on the opposite end of the bracket is adapted to engage the small hook of a hanging plant.

SUMMARY

In one aspect, the invention is embodied in an apparatus for displaying a plant. The apparatus includes a first substantially horizontal member for engagement with a first surface of a structure at a first vertical position. A second substantially horizontal member engages a second surface of the structure at a second vertical position that is lower than the first vertical position. The first surface is substantially opposite to the second surface. A frame is coupled to the second substantially horizontal member. The frame is shaped to support a pot containing the plant such that the weight of the supported plant urges the first substantially horizontal member against the first surface of the structure and the second substantially horizontal member against the second surface of the structure, thereby securing the apparatus to the structure.

In one embodiment, the first and second substantially horizontal members are formed from a first piece of material and the frame is formed from a second piece of material. The first piece of material can include a mechanical coupling that mates with a corresponding mechanical coupling of the second piece of material.

The apparatus can also include an inverted U-shaped member located between the first and second substantially horizontal members. The U-shaped member is shaped to engage a substantially horizontal structure.

In one embodiment, at least one of the first substantially horizontal member, the second substantially horizontal member, and the frame is formed from a metal material. The metal material can have a substantially circular cross-section. In one embodiment, the frame is adjustable to support a plurality of pots having different dimensions.

The structure can include a post. The weight of the supported plant urging the first substantially horizontal member against the first surface and the second substantially horizontal member against the second surface prevents the supported plant from moving down the post.

The shape of the pot can be chosen from the group comprising a cylinder, a cone, a square, and a rectangle. An extension member can be located between the second substantially horizontal member and the frame. The extension member can be adapted to separate the second substantially horizontal member from the frame.

In another aspect, the invention is embodied in an apparatus for displaying a plant. The apparatus includes a bracket having a first curved member for engagement with a first surface of a columnar-shaped structure at a first vertical position. The bracket includes a second curved member for engagement with a second surface of the columnar-shaped structure at a second vertical position that is lower than the first vertical position. A frame is coupled to the bracket. The frame is shaped to support a pot containing the plant such that the weight of the supported plant urges the first curved member against the first surface of the columnar-shaped structure and urges the second curved member against the second surface, thereby securing the apparatus to the columnar-shaped structure.

In one embodiment, the bracket includes a first piece of material and the frame includes a second piece of material. The first piece of material can include a mechanical coupling that mates with a corresponding mechanical coupling of the second piece of material.

The apparatus can also include an inverted U-shaped member located between the bracket and the frame. The inverted U-shaped member is shaped to engage a substantially horizontal structure.

In one embodiment, the bracket and/or the frame is formed from a metal material. The metal material can have a substantially circular cross-section. In one embodiment, the frame is adjustable to support a plurality of pots having different dimensions. The columnar-shaped structure can be a post.

The weight of the supported plant urging the first curved member against the first surface and the second curved member against the second surface prevents the supported plant from moving down the post. The shape of the pot can be chosen from the group including a cylinder, a cone, a square, and a rectangle.

In one embodiment, an extension member is located between the bracket and the frame. The extension member is adapted to separate the bracket from the frame.

BRIEF DESCRIPTION OF THE FIGURES

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. In addition, the description and drawings do not necessarily require the order illustrated. It will be further appreciated that certain actions and/or steps may be described or depicted in a particular order of occurrence while those skilled in the art will understand that such specificity with respect to sequence is not actually required. Apparatus and method components have been represented where appropriate by conventional symbols in the drawings, showing only those specific details that are pertinent to understanding the various embodiments so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

The above and further advantages of this invention may be better understood by referring to the following description in conjunction with the accompanying drawings, in which like numerals indicate like structural elements and features in various figures. Skilled artisans will appreciate that reference designators shown herein in parenthesis indicate components shown in a figure other than the one in discussion. For example, talking about a device (10) while discussing Figure A would refer to an element, 10, shown in figure other than Figure A.

DETAILED DESCRIPTION

The following detailed description is merely illustrative in nature and is not intended to limit the invention or the application and uses of the invention. Furthermore, there is no intention to be bound by any express or implied theory presented in the preceding technical field, background, brief summary or the following detailed description. For the purposes of conciseness, many conventional techniques and principles related to conventional plant hangers, need not, and are not, described in detail herein.

Techniques and technologies may be described herein in terms of functional components and various processing steps. It should be appreciated that such components may be realized by any number of hardware components configured to perform the specified functions.

The following description may refer to elements or features being "connected" or "coupled" together. As used herein, unless expressly stated otherwise, "connected" means that one element/feature is directly joined to (or directly communicates with) another element/feature. Likewise, unless expressly stated otherwise, "coupled" means that one element/feature is directly or indirectly joined to (or directly or indirectly communicates with) another element/feature. The term "exemplary" is used in the sense of "example, instance, or illustration" rather than "model," or "deserving imitation."

Technologies and concepts discussed herein relate to systems utilizing potted plants. In an exemplary embodiment, an apparatus for displaying a plant includes a first substantially horizontal member for engagement with a first surface of a structure at a first vertical position. A second substantially horizontal member engages a second surface of the structure at a second vertical position that is lower than the first vertical position. A frame is coupled to the second substantially horizontal member. The frame is shaped to support a pot containing the plant such that the weight of the supported plant urges the first substantially horizontal member against the first surface of the structure and the second substantially horizontal member against the second surface of the structure, thereby securing the apparatus to the structure. Besides plants, the apparatus can also support other objects, such as pumpkins or decorations.

Figure 1:
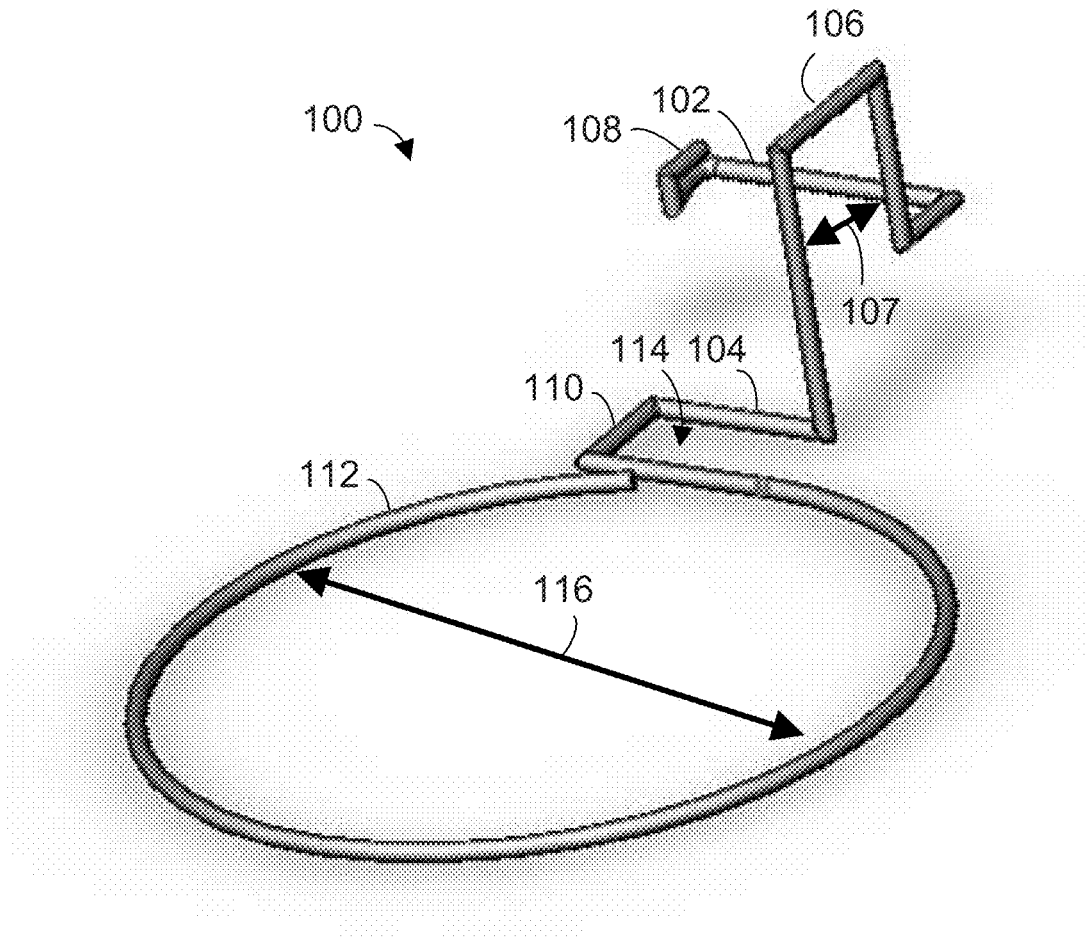
FIG. 1 is a perspective view of an apparatus for displaying a plant according to the invention.

FIG. 1 is a perspective view of an apparatus 100 for displaying a plant according to the invention. The apparatus 100 includes a first substantially horizontal member 102. A second substantially horizontal member 104 is coupled to the first substantially horizontal member 102. In one embodiment, an inverted U-shaped member 106 couples the first substantially horizontal member 102 to the second substantially horizontal member 104. In another embodiment, an inverted V-shaped member or any other suitable shape can also be used. The inverted U-shaped member 106 can assist in securing the apparatus 100 to a structure (not shown).

The inverted U-shaped member 106 can include a dimension 107 that corresponds to the thickness of a horizontal structure (not shown) to which the apparatus 100 can be attached. For example, the horizontal structure can be a two-inch by four-inch piece of material or a horizontal two-inch pipe supporting a chain link fence.

The first substantially horizontal member 102 can optionally include a hook 108 that secures the apparatus 100 to a link in a chain link fence (not shown). In one embodiment, the distance between the inverted U-shaped member 106 and the hook 108 corresponds to the approximate thickness of a post or other structure to which the apparatus 100 is attached.

In one embodiment, the distance between the first substantially horizontal member 102 and the second substantially horizontal member 104 corresponds to the approximate thickness of a post or other structure to which the apparatus 100 is attached.

The apparatus can also include an extension member 110. The extension member 110 can be located between the second substantially horizontal member 104 and a frame 112. The extension member 110 can be adapted to separate the second substantially horizontal member 104 from the frame 112. The length of the extension member 110 can be varied depending on the size of the plant to be displayed and/or the desired distance between the plant and the structure to which the apparatus 100 is attached.

In one embodiment, the distance between the second substantially horizontal member 104 and the frame 112 can correspond to the thickness of a picket on a picket fence. In this embodiment, the apparatus 100 can be secured to the picket fence by inserting the picket in the recess 114 between the second substantially horizontal member 104 and the frame 112.

The frame 112 is adapted to support a pot (not shown). In one embodiment, the frame 112 is adjustable to support pots having different dimensions. For example, the frame 112 can be substantially circular and its diameter 116 can be varied. In other embodiments, the frame can be substantially square, rectangular, triangular, or oval-shaped. In practice, any suitable shape can be used.

The apparatus 100 can be fabricated from any suitable material. In one embodiment, the apparatus 100 is fabricated from a metal material. For example, the apparatus 100 can be fabricated from stainless steel. In another embodiment, the apparatus 100 can be fabricated from a plastic material. The material can be a round stock material or a flat stock material. By round stock material, we mean a material having a substantially circular cross-section.

In operation, a user of the apparatus 100 adjusts the diameter 116 of the frame 112 to fit the pot (not shown) containing the plant to be displayed. The user then attaches the apparatus 100 to the structure on which the plant is to be displayed. For example, the user may attach the apparatus 100 to a vertical post by inserting the post between the first substantially horizontal member 102 and the second substantially horizontal member 104.

The user then inserts the pot containing the plant into the frame 112. The weight of the plant in the frame 112 urges the first substantially horizontal member 102 into a first surface of the post and urges the second substantially horizontal member 104 into a second surface of the post. The first surface of the post is opposite to the second surface of the post. In one embodiment, the second substantially horizontal member 104 can act as a cantilever for tilting the front of the frame 112 downward, thereby allowing the user to view a greater portion of the plant.

Figure 2A:
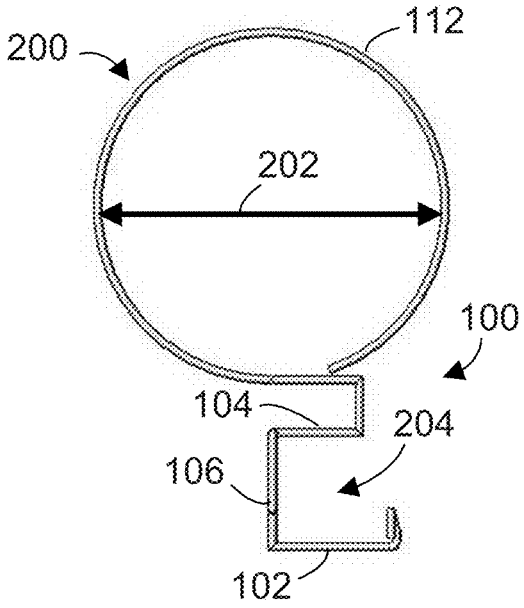
FIG. 2A and FIG. 2B illustrate top views of the apparatus of the present invention.
Figure 2B:
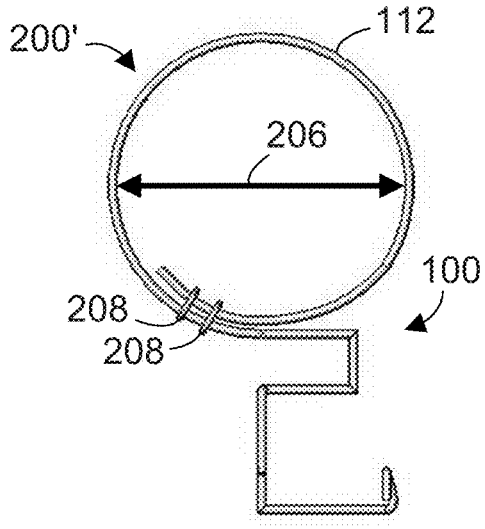

FIG. 2A and FIG. 2B illustrate top views 200, 200' of the apparatus 100 of the present invention. FIG. 2A illustrates the frame 112 having a first diameter 202. The first diameter 202 is adapted to support a round pot (not shown) having a large diameter. For example, the first diameter 202 can be between about twelve and twenty inches. The recess 204 is formed from the first 102 and second substantially horizontal members 104 and the inverted U-shaped member 106. In the embodiment shown, the recess 204 is shaped to accept a post having a square cross-section.

FIG. 2B illustrates the frame 112 having a second diameter 206. The second diameter 206 is adapted to support a round pot (not shown) having a smaller diameter. For example, the second diameter 206 can be between about four and ten inches. The frame 112 can include one or more clamps 208. The clamps 208 are used to prevent the diameter 206 of the frame 112 from unintentionally increasing. In one embodiment, the clamps 208 can be fabricated from washers, such as lock washers, or coils for example. Alternatively, the clamps 208 can be fabricated from sections of plastic or rubber tubing. Skilled artisans will appreciate that a variety of techniques can be used to secure the diameter 206 of the frame 112 without departing from the spirit and scope of the invention.

Figure 3:
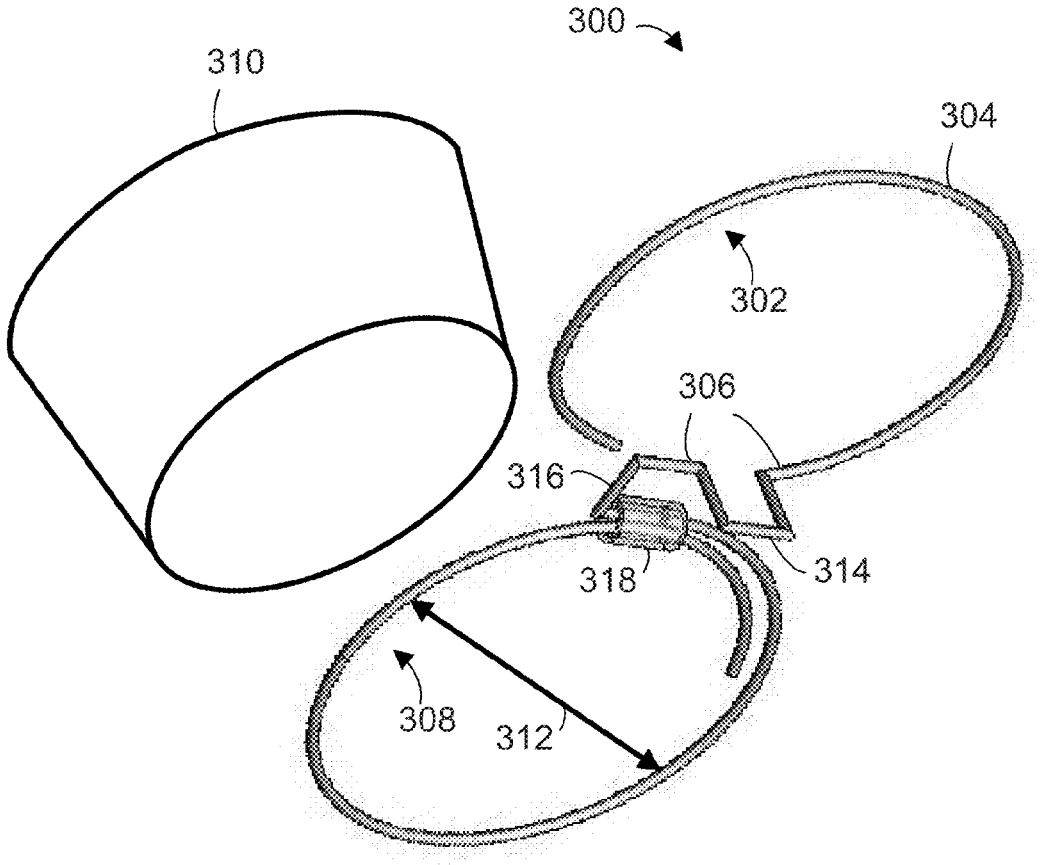
FIG. 3 is a perspective view of an apparatus for displaying a plant according to another embodiment of the invention.

FIG. 3 is a perspective view of an apparatus 300 for displaying a plant according to another embodiment of the invention. The apparatus 300 includes a bracket 302 having a first curved section 304 for engagement with a first surface of a columnar-shaped structure (not shown) at a first vertical position. The bracket 302 includes a second curved section 306 for engagement with a second surface of the columnar-shaped structure at a second vertical position that is lower than the first vertical position.

A frame 308 is coupled to the bracket 302. The frame 308 is shaped to support a pot 310 containing a plant (not shown) such that the weight of the supported plant urges the first curved section 304 against the first surface of the columnar-shaped structure and urges the second curved section 306 against the second surface, thereby securing the apparatus 300 to the columnar-shaped structure. The columnar-shaped structure can be a pole, such as a telephone pole, a column supporting a roof, or a trunk of a tree, for example.

The frame 308 is adapted to support the pot 310. In one embodiment, the frame 308 is adjustable to support pots having different dimensions. For example, the frame 308 can be substantially circular and its diameter 312 can be varied. In other embodiments, the frame 308 can be substantially square, rectangular, triangular, or oval-shaped. In practice, any suitable shape can be used.

The apparatus 300 can also include an optional perch 314. The perch 314 is positioned adjacent to, or alternatively, formed in the second curved section 306. In one embodiment, the perch 314 provides additional support to the apparatus 300 when the pot 310 is inserted into the frame 308. For example, the weight of the pot 310 urges the perch 314 against the second surface of the columnar-shaped structure, thereby providing additional support.

In one embodiment, an extension member 316 is located between the bracket 302 and the frame 308. The extension member 316 is adapted to separate the bracket 302 from the frame 308. For example, the extension member 316 can be used to situate the pot 310 a short distance away from the columnar-shaped structure. The length of the extension member 316 can be varied depending on the size of the plant to be displayed and/or the desired distance between the plant and the columnar-shaped structure.

In one embodiment, the bracket 302 is fabricated from a first piece of material and the frame 308 is fabricated from a second piece of material. The first piece of material can include a mechanical coupling that mates with a corresponding mechanical coupling formed on the second piece of material.

In one embodiment, the bracket 302 and/or the frame 308 is formed from a metal material. For example, the metal material can be a flexible stainless steel. The metal material can have a substantially circular cross-section. As previously described, the frame 308 can be adjustable to support a plurality of pots having different dimensions. The frame 308 can also include one or more clamps 318. The clamps 318 are used to prevent the diameter 312 of the frame 308 from unintentionally increasing. The bracket 302 and/or the frame 308 can be coated in vinyl or plastic to protect the columnar-shaped structure.

In operation, a user of the apparatus 300 adjusts the diameter 312 of the frame 308 to fit the pot 310 containing the plant to be displayed. The user then attaches the bracket 302 to the columnar-shaped structure on which the plant is to be displayed. For example, the user may attach the bracket 302 to a trunk of a tree by inserting the trunk between the first curved section 304 and the second curved section 306.

The user then inserts the pot 310 containing the plant into the frame 308. The weight of the plant in the frame 308 urges the first curved section 304 against a first surface of the tree trunk and urges the second curved section 306 against a second surface of the tree trunk. In one embodiment, the perch 314 can act as a cantilever for tilting the front of the frame 308 downward, thereby allowing the user to view a greater portion of the plant.

Figure 4:
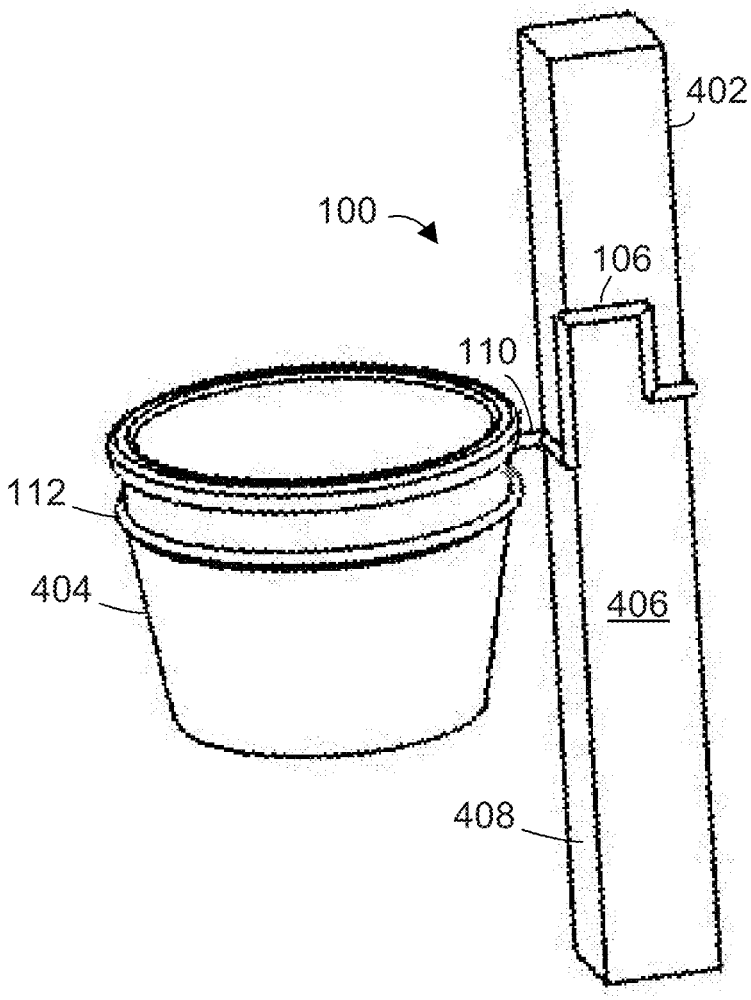
FIG. 4 illustrates a perspective view of the apparatus of FIG. 1 attached to a post.

FIG. 4 illustrates a perspective view of the apparatus 100 of FIG. 1 attached to a post 402. The apparatus 100 includes the frame 112 supporting a pot 404. This embodiment includes the inverted U-shaped member 106. Skilled artisans will appreciate that other suitable shapes can be used instead of an inverted U-shape. Upon installation, the inverted U-shaped member 106 contacts a surface 406 of the post 402 to provide additional support to the apparatus 100. The extension member 110 separates the pot 404 from a surface 408 of the post 402. The post 402 can be a wooden or a vinyl fence post having a substantially square cross-section. The post 402 can be a standard four inch by four inch, six by six inch, or eight inch by eight inch post. In other embodiments, the post can have a substantially rectangular cross-section (not shown).

Figure 5:
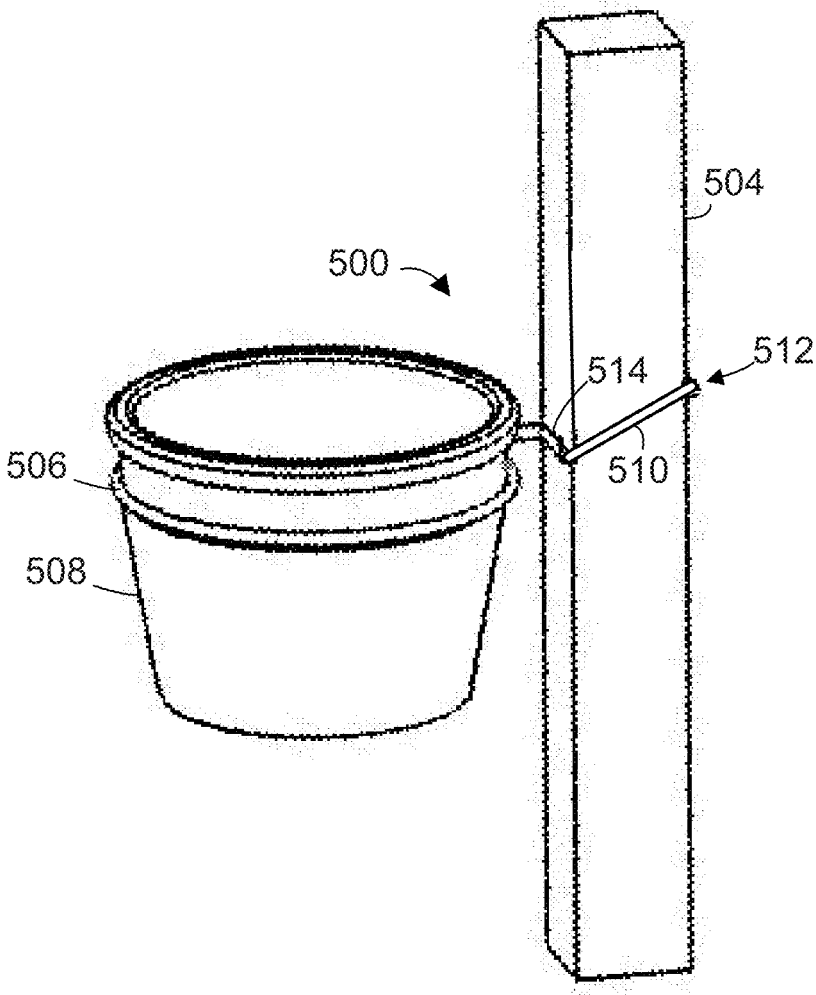
FIG. 5 illustrates a perspective view of an apparatus attached to a post according to one embodiment of the invention.

FIG. 5 illustrates a perspective view of an apparatus 500 according to one embodiment of the invention. The apparatus 500 is attached to a post 504. The apparatus 500 includes a frame 506 supporting a pot 508. This embodiment does not include an inverted U-shaped member. Instead, a coupling member 510 couples a first horizontal member 512 to a second horizontal member 514. Skilled artisans will appreciate that other suitable techniques for coupling the first horizontal member 512 to the second horizontal member 514 can also be used.

Figure 6:
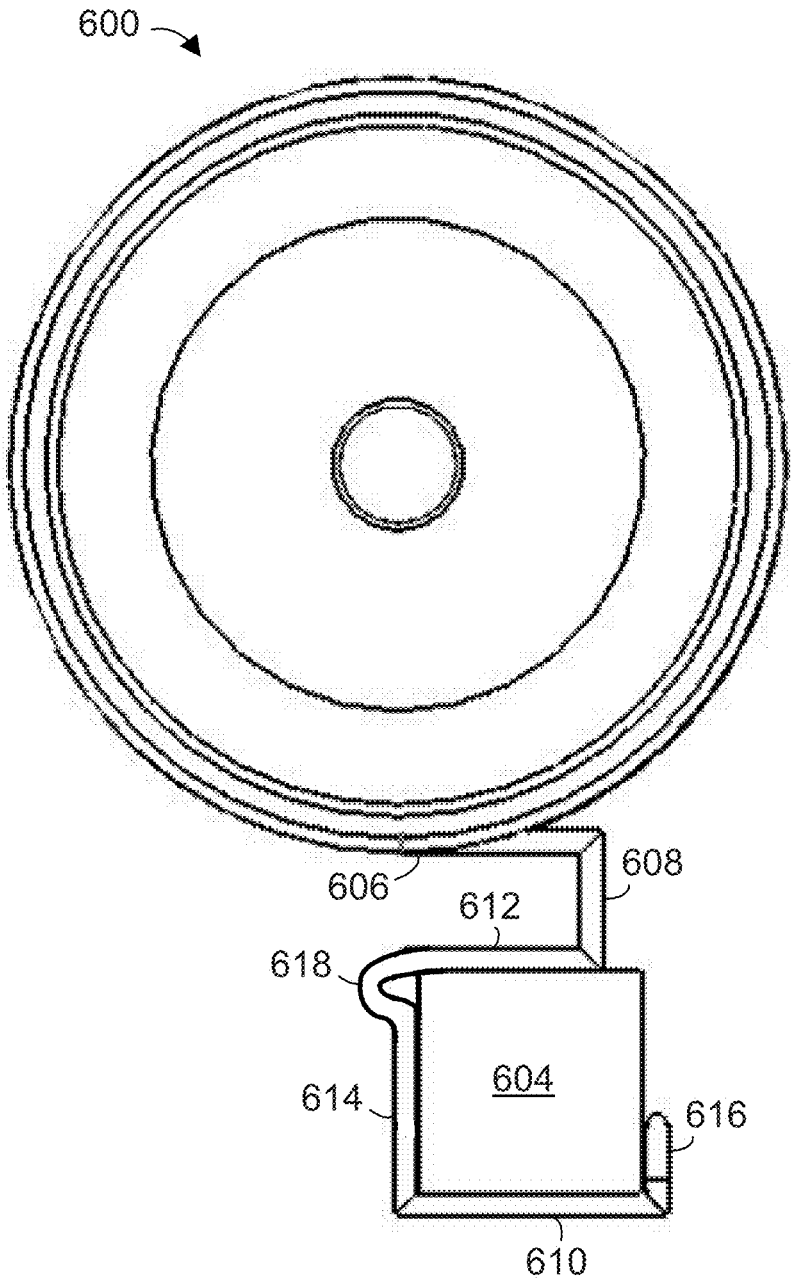
FIG. 6 illustrates a top view of an apparatus attached to a post according to another embodiment of the invention.

FIG. 6 illustrates a top down view of an apparatus 600 attached to a post 604 according to another embodiment of the invention. The apparatus 600 includes a frame 606, an extension member 608, first 610 and second horizontal members 612, an inverted U-shaped member 614, and a hook 616. The apparatus 600 is attached to the post 604 having a substantially square cross-section. In one embodiment, the apparatus 600 includes an optional relief 618. The relief 618 is adapted to allow the apparatus 600 to fit on a post having a non-standard size. For example, a four inch by four inch wooden post has a thickness that is generally around three and one-half inches per side, whereas a four inch vinyl fence post has a thickness that is truly four inches per side.

Figure 7:
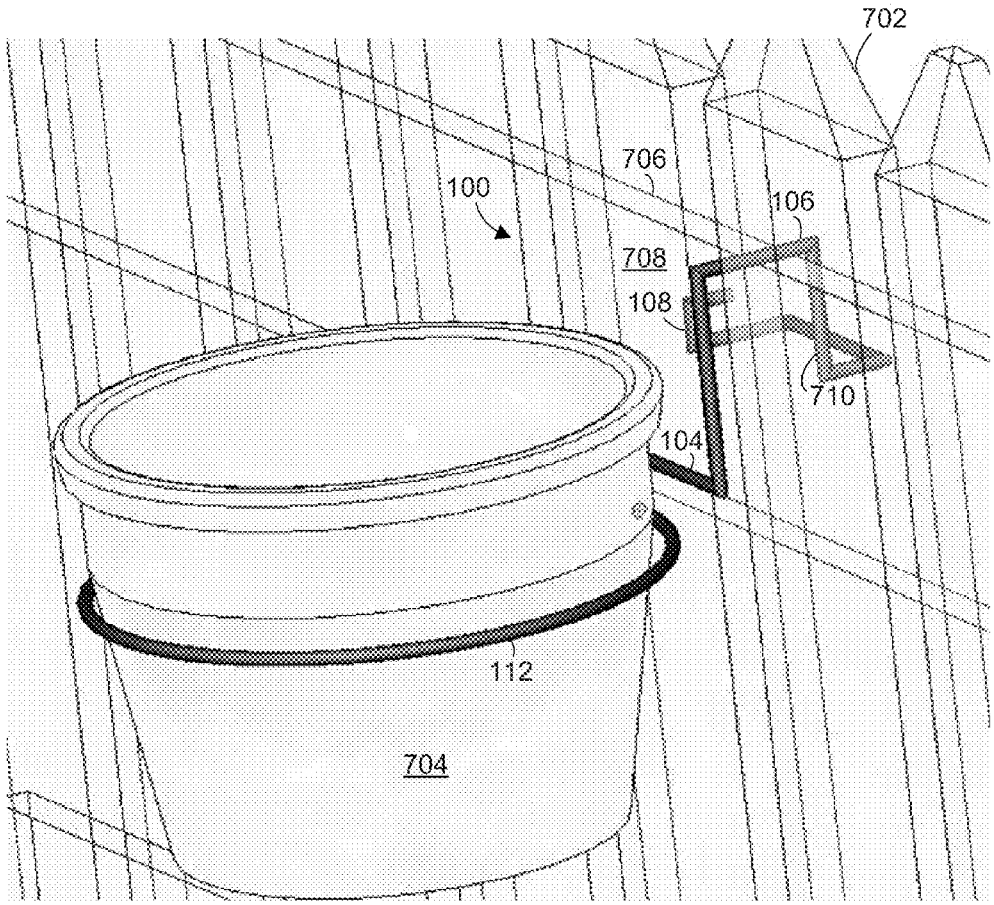
FIG. 7 illustrates a perspective view of the apparatus of FIG. 1 attached to a picket-type fence.

FIG. 7 illustrates a perspective view of the apparatus 100 of FIG. 1 attached to a picket-type fence 702. The apparatus 100 includes the frame 112 containing a pot 704. The optional inverted U-shaped member 106 engages a horizontal structure 706 of the fence 702. The weight of the pot 704 containing a plant urges the second horizontal member 104 against a picket 708 and a portion 710 of the inverted U-shaped member 106 against the horizontal structure 706 of the fence 702. In one embodiment, a portion of the optional hook 108 is also urged against the horizontal structure 706 of the fence 702. In one embodiment, the horizontal structure 706 is a one-inch by six-inch cross beam used to support each picket in a vertical position.

Figure 8:
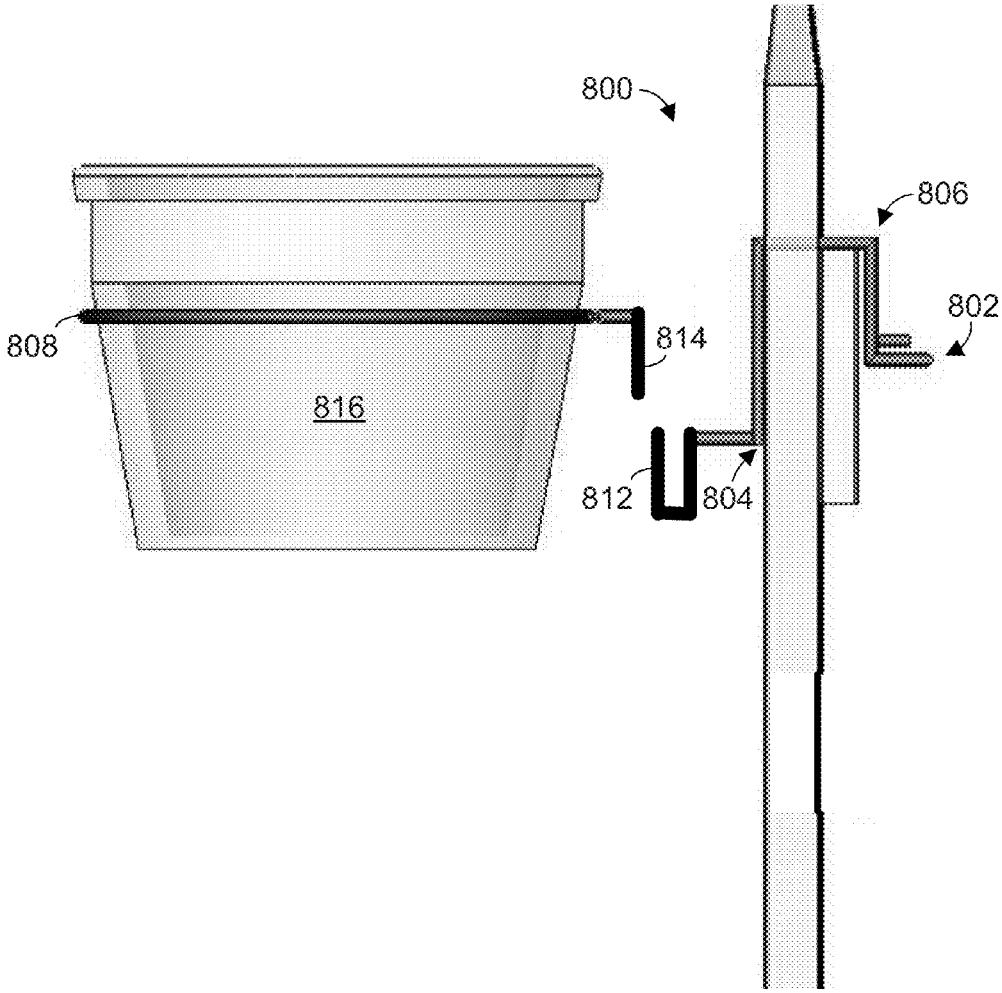
FIG. 8 illustrates a side view of an apparatus for displaying a plant according to one embodiment of the invention.

FIG. 8 illustrates an apparatus 800 for displaying a plant according to one embodiment of the invention. The apparatus 800 is embodied in a two-piece design. The two-piece design includes a bracket and a frame. First 802 and second substantially horizontal members 804 are fabricated from a first piece of material and form the bracket 806. A frame 808 is fabricated from a second piece of material. In one embodiment, the bracket 806 includes a mechanical coupling 812. The frame 808 also includes a mechanical coupling 814 that mates with the corresponding mechanical coupling 812 of the bracket 806. Skilled artisans will appreciate that the bracket 806 and the frame 808 can be coupled using a variety of techniques.

Although the frame 808 is illustrated containing a pot 816, various other accessories can be coupled to the mechanical coupling 812 of the bracket 806. For example, an apparatus (not shown) including a plurality of frames for displaying multiple plants can be coupled to the bracket 806.

Figure 9:
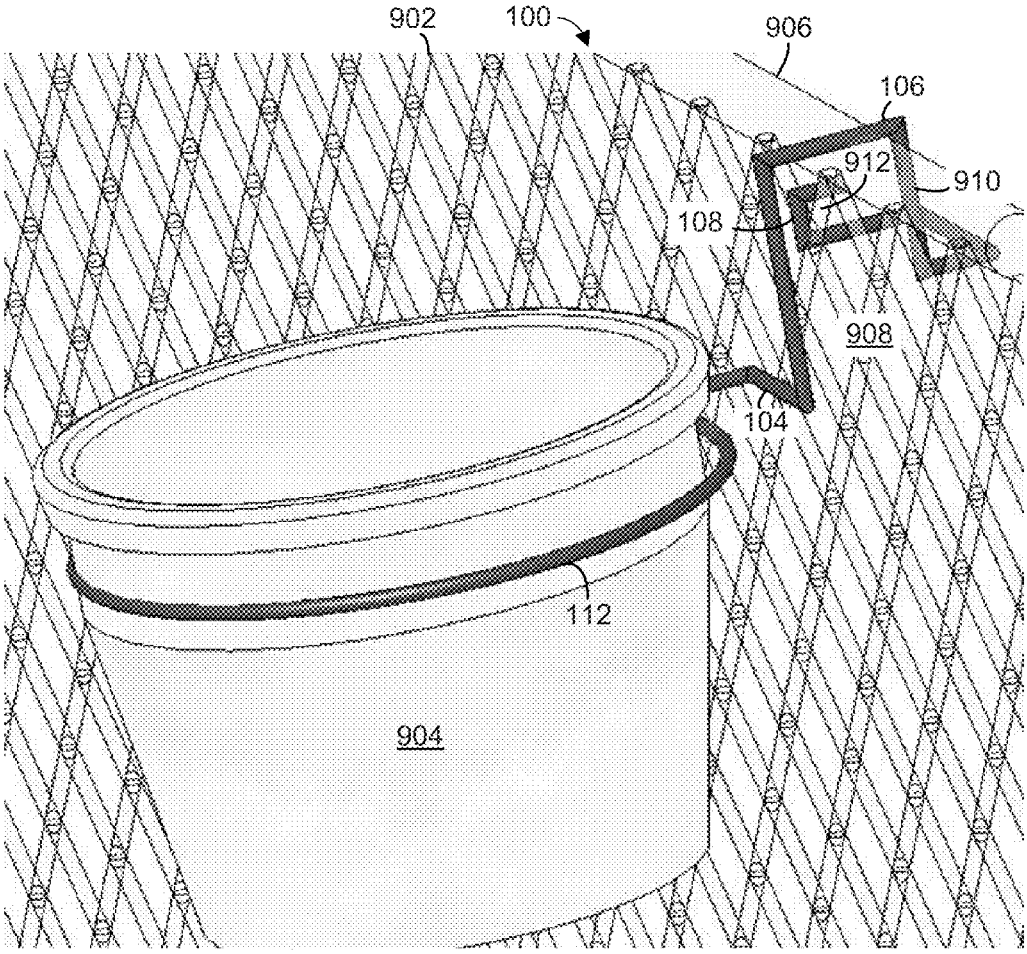
FIG. 9 illustrates a perspective view of the apparatus of FIG. 1 attached to a chain link fence.

FIG. 9 illustrates a perspective view of the apparatus 100 of FIG. 1 attached to a chain link fence 902. The apparatus 100 includes the frame 112 containing a pot 904. The optional inverted U-shaped member 106 engages a horizontal structure 906 of the fence 902. The weight of the pot 904 urges the second horizontal member 104 against the chain 908 and a portion 910 of the inverted U-shaped member 106 against the horizontal structure 906. In one embodiment, the optional hook 108 engages a chain link 912 of the fence 902 to further secure the apparatus 100 to the fence 902. In one embodiment, the horizontal structure 906 is a metal pipe used to support the chain links. The metal pipe can be a standard two-inch diameter pipe.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While at least one example embodiment has been presented in the foregoing detailed description, it should be appreciated that a vast number of variations exist. It should also be appreciated that the example embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

In addition, the section headings included herein are intended to facilitate a review but are not intended to limit the scope of the present invention. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item implemented structure or function;

e) any of the disclosed devices or portions thereof may be combined together or separated into further portions unless specifically stated otherwise; and f) no specific sequence of acts or steps is intended to be required unless specifically indicated.

What is claimed is:

1. An apparatus for displaying a plant, comprising:

a first substantially horizontal member for engagement with a first surface of a structure at a first vertical position;

a second substantially horizontal member for engagement with a second surface of the structure at a second vertical position that is lower than the first vertical position, the first surface being substantially opposite to the second surface;

an inverted U-shaped member located between the first and second substantially horizontal members and being shaped to engage a substantially horizontal structure; and a frame coupled to the second substantially horizontal member and being shaped to support a pot containing the plant such that the weight of the supported plant urges the first substantially horizontal member against the first surface of the structure and the second substantially horizontal member against the second surface of the structure, thereby securing the apparatus to the structure, a diameter of the frame being adjustable to fully surround any one of a plurality of pots having different diameters.

2. The apparatus of claim 1, wherein the first and second substantially horizontal members comprise a first piece of material and the frame comprises a second piece of material.

3. The apparatus of claim 2, wherein the first piece of material includes a mechanical coupling that mates with a corresponding mechanical coupling of the second piece of material.

4. The apparatus of claim 1, wherein the substantially horizontal structure comprises one of a deck railing, a horizontal pipe, a picket fence, and a horizontal fence support.

5. The apparatus of claim 1, wherein at least one of the first substantially horizontal member, the second substantially horizontal member, and the frame is flamed from a metal material comprising a substantially circular cross-section.

6. The apparatus of claim 1, wherein the frame further comprises a clamp for locking the frame around the any one of the plurality of pots having the different diameters.

7. The apparatus of claim 1, wherein the structure comprises a post.

8. The apparatus of claim 7, wherein the weight of the supported plant urging the first substantially horizontal member against the first surface and the second substantially horizontal member against the second surface prevents the supported plant from moving down the post.

9. The apparatus of claim 1, wherein a shape of the pot is chosen from the group consisting of a cylinder, a cone, a square, and a rectangle.

10. The apparatus of claim 1, further comprising an extension member located between the second substantially horizontal member and the frame and being adapted to separate the second substantially horizontal member from the frame.

* * * * *